United States Patent [19]

Thompson

[11] Patent Number: 4,799,997

[45] Date of Patent: Jan. 24, 1989

[54] SYSTEM FOR SENSING A DISCONTINUITY IN A PAPER WEB AND CONTAINING WEB PUNCTURING MEANS ACROSS THE WEB WIDTH

[75] Inventor: Robert H. Thompson, Hollins, Va.

[73] Assignee: Westvaco Corporation, New York, N.Y.

[21] Appl. No.: 82,274

[22] Filed: Aug. 6, 1987

[51] Int. Cl.[4] ..... D21F 7/04

[52] U.S. Cl. ..... 162/255; 83/511; 162/286

[58] Field of Search ..... 162/286, 255, 194; 83/566, 511, 371; 493/372

[56] References Cited

U.S. PATENT DOCUMENTS

| | | | |
|---|---|---|---|
| 1,620,037 | 3/1927 | Peschl | 162/255 |
| 1,634,885 | 7/1927 | Peschl | 162/255 |
| 1,662,200 | 3/1928 | Merrill | 162/255 |
| 1,745,687 | 2/1930 | Peschl | 162/255 |
| 1,838,603 | 12/1931 | Witham, Sr. | 162/255 |
| 2,043,554 | 6/1936 | Potdevin | 83/566 |
| 2,667,106 | 1/1954 | Hyman et al. | 162/255 |
| 3,355,349 | 11/1967 | Devlin | 162/255 |
| 3,770,579 | 11/1973 | Cline | 162/255 |
| 4,671,151 | 6/1987 | Rooney | 83/566 |

*Primary Examiner*—Steve Alvo

*Attorney, Agent, or Firm*—W. A. Marcontell; R. L. Schmalz

[57] ABSTRACT

A system for sensing a web break using web break detection instruments. Upon sensing a break a strategically located, full web width deflection cam bears against the machine web upstream of the detected break. Under the bias of the deflector, the web running route is pushed into a saw-toothed cutter blade. Saw-tooth points simultaneously penetrate the web along a line traversing the full web width. Such line of web penetration becomes an immediate line of full width web breakage but at a location along the machine length designed to accommodate the waste production (broke) until web continuity along the remainder of the machine length is restored.

3 Claims, 2 Drawing Sheets

FIG. 3
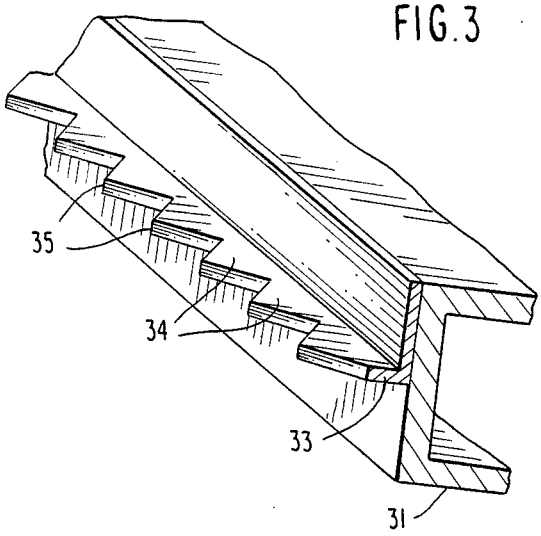
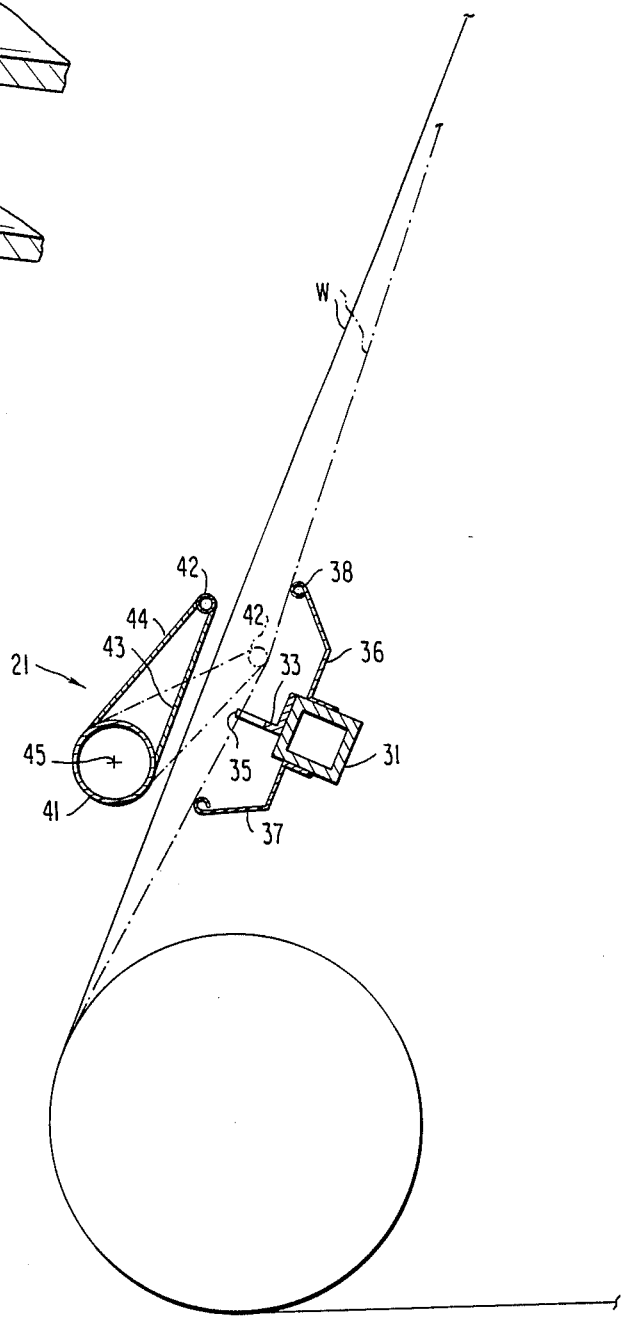
FIG. 2

SYSTEM FOR SENSING A DISCONTINUITY IN A PAPER WEB AND CONTAINING WEB PUNCTURING MEANS ACROSS THE WEB WIDTH

BACKGROUND OF THE INVENTION

1. Field Of The Invention

The present invention relates to the art of papermaking and the machines that form paper as a continuous web.

2. Background Of The Invention

As practiced by the present state-of-the-art, papermachines produce a continuous, fourdrinier laid web at velocities of 1,000 to 3,000 feet per minute. In the course of processing and finishing, numerous opportunities are presented within the machine to break and therefore interrupt the web continuity. Along most of the machine length, a web break may have no consequence on the web production upstream of the rupture. Although the paper product at the point of rupture is unfinished, the fiber material substance of the unfinished product is recoverable as "broke" which is reslurried into pulp and recycled through the machine. Accordingly, the machine is rarely stopped in the event of a web rupture. Production of broke is allowed to continue until the web is rethreaded through the machine remainder.

There are, however, some negative consequences of continued broke production while the machine is rethreaded. The first and most obvious is the massive quantity of broke material that could be dumped, uncontrollably, upon the machine operating floor. Fortunately, this negative consequence is easily avoided by strategically breaking the web at one of several locations along the machine length. At these strategic locations, an opening is provided in the operating floor through which the unfinished web is routed directly into broke handling equipment.

The negative consequence of web breaks within specific process equipment may be far more damaging or destructive. In the cases of calenders and coaters, nip running rolls may be wrapped by the leading edge of the broken web. Subsequent production continues to build upon the wrap. Destructive consequences to the equipment follow quickly thereafter.

For these reasons, web detection instruments have been developed to continuously monitor machine web continuity. When the web ruptures, one of these instruments downstream of the break will signal the failure. Upon signal, an appropriate web cutting or breaking mechanism upstream of the rupture point will act to break the web a second time but at one of the strategic locations.

Traditionally, the strategic break was made manually: by snapping the web edge with fingers or a hand along an accessible, and unsupported portion of the web route. Now, the break is made mechanically with a jet of air or water: but still at one edge of the web. Once the web edge is broken, web tensile stress continues the tear across the machine.

A full width cut of the web i.e. instantaneous severance of the web across the full width thereof, is most desirable. This, however, necessarily requires mechanical equipment. If perceived in the context of a knife or shear, automatic operation is hazardous to people working around the equipment. Probabilities are too great that some human body part will be in the shear or knife plane when operation occurs.

It is therefore, an object of the present invention to provide a mechanism which instantly severs a papermachine web across the entire width thereof without jeopardizing the safety of human attendants.

Another object of the present invention is to provide a papermachine web severing mechanism having no shearing elements or sharp edges.

Another object of the present invention is to provide a papermachine web severing mechanism that ruptures the entire web width along a line substantially perpendicular to the machine running direction.

SUMMARY

These and other objects of the invention are achieved by a web cutting mechanism having a coarse saw-tooth blade mounted in a fixed position across and adjacent to the web route. The saw-tooth points are directed into one side of the web. On the opposite side of the web is a rotatable, web deflector cam which, when rotated, deflects the web route into the standing blade points. Web penetration at the numerous points of the blade immediately ruptures the web material between the penetration points for a relatively clean, square break.

As with prior art web breakdown systems, the web breaking mechanism of the present invention operates in response to a web continuity sensing instrument.

In the preferred embodiment, two web cutting mechanisms of the invention are provided to protect on-line web calendering and coating machinery, respectively. A first web continuity sensor is disposed after a calender stack to operate a web cutter immediately prior to the calender stack. A second continuity sensor is disposed after an on-line coater to operate a second web cutter positioned between the calender and the coater.

BRIEF DESCRIPTION OF THE DRAWINGS

The preferred embodiment of the invention is described by reference to drawings wherein like reference characters designate like or similar elements throughout the several figures of the drawings.

FIG. 2 is an elevational section of the present invention, and FIG. 3 illustrates a portion of the saw-toothed blade element of the present invention.

PREFERRED EMBODIMENT

Figure 1:
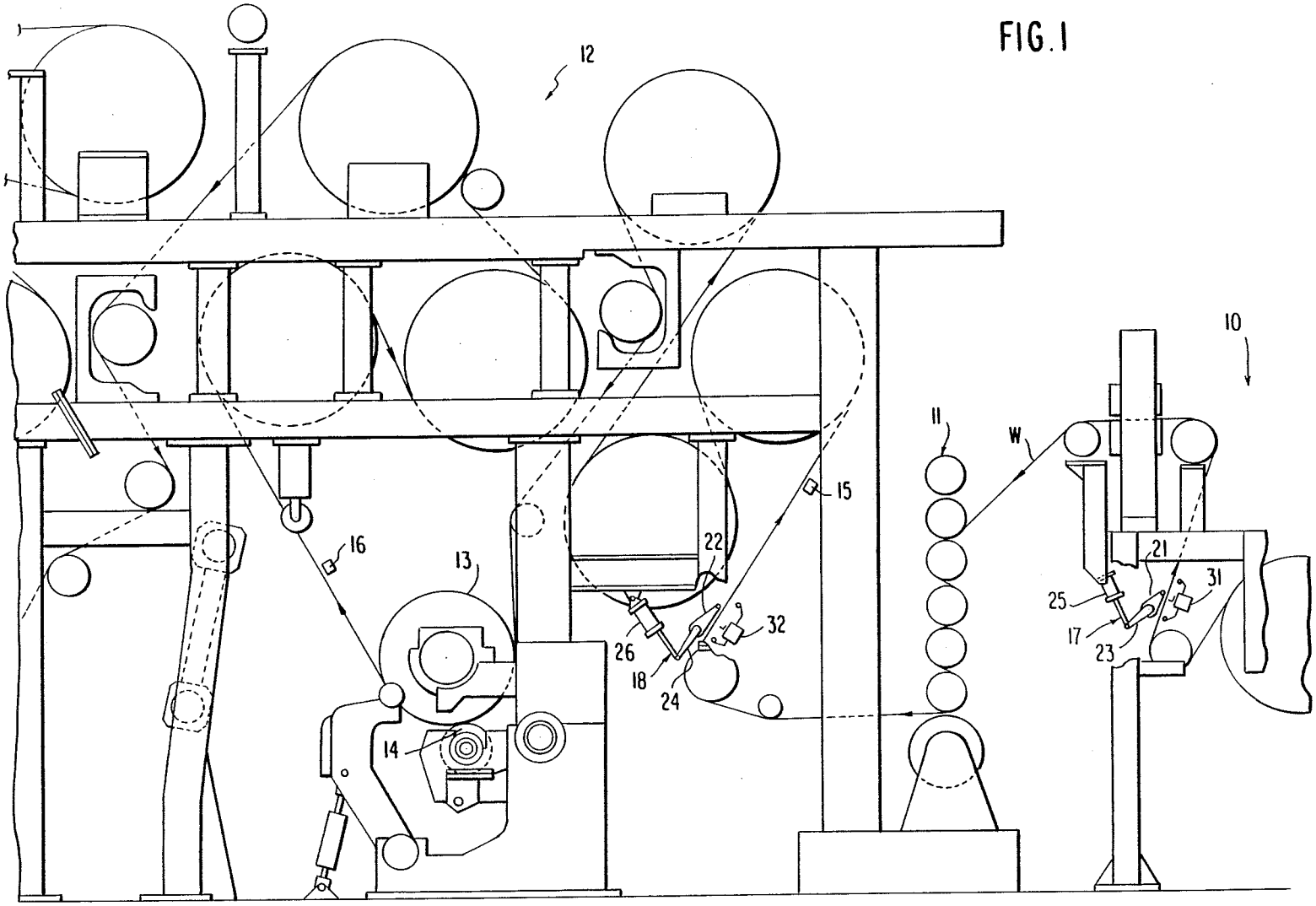
FIG. 1 schematically illustrates a typical papermachine elevational layout including integration of the present invention.

FIG. 1 schematically illustrates a portion of the dry end of a papermachine wherein the web W emerges from a main dryer section 10 and enters a first calender stack 11. Following the calender stack, the web is routed around the first several drums, three in this case, of an intercalender dryer section 12. After these first several drums, the web is turned about a coating roll 13 and receives a fluidized surface coating applied by applicator roll 14. From the coating roll 13, the web route returns to the intercalender dryers.

After the intercalender dryers, the web may be calendered a second time or directly reeled.

To protect the calender stack 11 and coating rolls 13 and 14 from web wrapping in the event of a web break, web continuity sensors 15 and 16 are secured to machine frame members proximate of the web route after the calender 11 and coater 13, respectively. Cooperatively responsive to the sensors 15 and 16 are web cutters 17 and 18, respectively. Both cutters are engaged by rotation of axis mounted deflector cams 21 and 22.

To rotatively operate the deflectors 21 and 22, each is provided with respective crank arms 23 and 24. Piston/-cylinder actuating motors 25 and 26 are connected between the distal end of respective crank arms 23 and 24 and the machine frame. These motors 25 and 26 convert the energy of pressurized fluid to forceful mechanical motion of the crank arms.

Also secured to the machine frame but on the opposite side of the web route from the deflector cams are knife beams 31 and 32. As will be noted from the details of FIGS. 2 and 3, the term "knife" is given specialized meaning. The web is not sheared as in "sliced" but punctured at the numerous tooth points 35. Tensile failure of the web between the punctures completes the web separation.

In this embodiment of the invention, the knife beam 31 comprises a square structural tubing transversely spanning the web running direction. To the beam 31 is secured, as by welding, for example, a knife blade 33 fabricated from structural angle. One leg of the angle serves as a mounting base against a beam flat and the other leg is notched to form pointed teeth 34, each tooth having an apex point 35.

Shields 36 and 37 are secured to the beam 31 flats flanking the blade 33. These shields restrict manual access to the proximity of the knife teeth 34. Distal edges 38 and 39 of the shields are rolled or welded to pipe sections.

Fabrication of the deflector cams 21 and 22 is also light and abbreviated. A circular tube section 41 of about 6 in. nominal diameter serves as the primary structural element and torque tube. A smaller diameter tube 42 of about 1 in. nominal diameter is the secondary element and web engaging lobe. The length of the two tubes 41 and 42 is unitized by 16 ga. sheet metal skins 43 and 44. Opposite ends of the torque tube 41 are journaled with the papermachine frame for rotation about tube axis 45. Crank arms 24 drive such rotation Upon occurrence of a web failure in the calender stack 11, such discontinuity is detected by the sensor 15 which actuates a fluid pressure control source (not shown) to motor 26. Deflector 22 is rotated against the web W by the motor 26 driven crank arm 24. As the deflector lobe 42 bears against the web, it is displaced from its normal running route to the dashed line path of FIG. 2. Internal web tension when running along the dashed line path presses the web into the tooth points 35 which penetrate and initiate separation.

To underscore the safety of the invention, the web is severed without metal-to-metal contact. The deflector and knife beam may be reactively positioned on the papermachine to avoid sufficient proximity between surface elements of the deflector and those of the knife as to injure any human body extremity that could be present at the moment of automatic operation.

Equally important to the inherent safety of the invention is the feature that the automatically moving element, the deflector, has no sharp or abrupt edges capable of human injury. Although the knife teeth 34 need not be sharp as the term is normally understood, the profile edges should be sufficiently abrupt as to penetrate the web under moderate pressure. Reversal of the functions whereby the toothed element becomes the moving member raises the possibility of human injury.

Having fully described my invention, I claim:

1. A web breakdown system in a papermachine having a normal production web route and web calendering means comprising:

(a) web continuity sensor means disposed adjacent said web route downstream of said calendering means for issuing a signal in the event of web discontinuity;

(b) web route displacement means disposed adjacent said web route, on one side thereof, upstream of said calendering means;

(c) web puncturing means comprising a plurality of web puncturing elements disposed adjacent to and across substantially the entire width of said web route, said puncturing means being positioned on the other side of said web route from said displacement means and upstream of said calendering means;

(d) actuating means responsive to said web discontinuity signal for operating said web route displacement means and locally displacing the route of a moving web within said papermachine into penetrating engagement with said puncturing means; and, (e) said puncturing and deflection means being separated by distances sufficient to avoid injury to human body extremities present therebetween when said displacement means is operated by said actuating means.

2. An apparatus as described by claim 1 wherein said web route displacement means is a rotary cam shaped element having a web engaging lobe, said actuating means being connected to said cam to rotate same about an axis between respective angular positions of web engagement by said lobe and web disengagement thereby.

3. An apparatus as described by claim 1 wherein said puncturing means comprises a saw-toothed element disposed across the width of said web.

* * * * *